United States Patent [19]

Sofy

[11] Patent Number: 4,895,013

[45] Date of Patent: Jan. 23, 1990

[54] WORKPIECE TRANSFER APPARATUS FOR A PUNCH PRESS

[76] Inventor: Hugh M. Sofy, 201 Warrington Dr., Bloomfield Hills, Mich. 48013

[21] Appl. No.: 281,543

[22] Filed: Dec. 8, 1988

[51] Int. Cl.[4] ..... B21J 13/08

[52] U.S. Cl. ..... 72/405; 198/621; 198/751; 414/750

[58] Field of Search ..... 72/405; 192/150; 198/856, 621, 774, 751, 719; 414/751, 750

[56] References Cited

U.S. PATENT DOCUMENTS

| | | | |
|---|---|---|---|
| 3,661,247 | 5/1972 | Wallis | 198/621 |
| 3,738,503 | 6/1973 | Wallis | 414/750 |
| 3,746,184 | 7/1973 | Wallis | 198/621 |
| 4,198,845 | 4/1980 | Sofy | 198/621 |
| 4,513,602 | 4/1985 | Sofy | 72/405 |
| 4,540,087 | 9/1985 | Mizumoto | 72/405 |

FOREIGN PATENT DOCUMENTS

| | | | |
|---|---|---|---|
| 2047197 | 4/1971 | Fed. Rep. of Germany | 72/405 |

*Primary Examiner*—Daniel C. Crane

*Attorney, Agent, or Firm*—Reising, Ethington, Barnard, Perry & Milton

[57] ABSTRACT

A workpiece transfer apparatus (10) for a punch press (12) including a first jaw (80) for engaging one side of workpieces (16) progressively forming die stations, and a second jaw (82) for engaging the other side of the workpieces (16). The reciprocating motion of the press ram (14) oscillates a first (34) and a second (36) rocker arm in unison. The first rocker arm (34) is connected to the first jaw (80) through a first clutch (26) and the second rocker arm (36) is connected to the second jaw (82) through a second clutch (28). As the rocker arms (34, 36) oscillate, they drive the jaws (80, 82) longitudinally of the die stations to progressively index the workpieces (16) from one die station to the next. When a predetermined level of resistance against one of the first (80) or second (82) jaws is encountered during operation, that respective first (26) or second (28) clutch will disengage the associated rocker arm (34, 36) while the other first (80) or second (82) jaw remains operatively connected to its rocker arm (34, 36).

32 Claims, 5 Drawing Sheets

WORKPIECE TRANSFER APPARATUS FOR A PUNCH PRESS

TECHNICAL FIELD

The subject invention relates to an apparatus driven by the ram of a punch press for moving workpieces progressively from one die station to another so that a plurality of sequential forming operations may be performed on them, and more particularly to a safety clutch arrangement for use with such an apparatus.

BACKGROUND ART

Workpiece transfer apparatuses for punch presses of the type including a reciprocating ram actuated against a series of in-line progressively forming die stations for moving workpieces progressively from one die station to the next are well known in the art. For many applications, a transfer apparatus is most effective when actuation is via mechanical linkages responsive to the reciprocation of the press ram. Transfer apparatuses of this type embrace the workpieces from opposite sides and then index them to their respective next die stations as the press ram ascends. The transfer apparatuses retract from the workpieces and reposition themselves to a starting position as the press ram descends.

It will be readily appreciated by those skilled in the art that jamming of the transfer apparatus due to mislocated workpieces, and the like, is a frequent occurrence. The likelihood of a jam, therefore, must be considered in the design of any workpiece transfer apparatus so that when the jam occurs, the transfer apparatus will cease to respond to the press ram movements to prevent damage.

The prior art teaches the use of a safety clutch to disengage workpiece engaging jaws on the transfer apparatus from responding to the press ram movements. Examples of these prior art teachings may be found in U.S. Pat. No. 4,198,845, issued Apr. 22, 1980, and 4,513,602, issued Apr. 30, 1985, both to the inventor of the subject application. These prior art patents disclose mechanically actuated workpiece transfer apparatuses each including a drive rock shaft supported for oscillation in fixed bearings and having one or two rocker arms extending from the drive rock shaft to displace two workpiece engaging jaws. One safety clutch is provided between the two jaws and the drive rock shaft to simultaneously release both jaws from actuation upon a predetermined resistance against the driving force. In other words, the two workpiece engaging jaws, although separate members, are actuated through a common clutch, so that upon the occurrence of a jam, the two jaws simultaneously disengage from further actuation.

As is well known, the single safety clutch of a prior art workpiece transfer apparatus is frequently preset to a minimum threshold release, i.e., disengagement, value so that normal operating resistances against the driving force do not accidentally trip the single clutch. In this example, the threshold value for the safety clutch is set to disengage at a one hundred pound resistance against the driving force. In other words, the single prior art safety clutch will disengage when resistance against the driving force exceeds the one hundred pound threshold value. More often than not, a workpiece jam will only exert resistance against one of the workpiece engaging jaws. This jammed workpiece, therefore, must exert a resistance in excess of the one hundred pound threshold hold value against that one jaw in order to disengage the safety clutch. Damage may result to very expensive equipment when the jammed workpiece is unable to exert the requisite resistance against the one jaw. In these type situations where the jam is not of sufficient magnitude to trip the single safety clutch, damage will inevitably result.

SUMMARY OF THE INVENTION AND ADVANTAGES

A workpiece transfer apparatus for a press of the type including a reciprocating forming member actuated against a series of in-line progressively forming die stations is provided. The apparatus comprises a first engagement means for engaging one side of a workpiece disposed in a die station, a second engagement means for engaging the other side of a workpiece disposed in a die station, and a drive means for imparting a driving force to the first and second engagement means to move the workpiece from the die station. The subject invention is characterized by including a clutch means operatively connecting the drive means to the first and second engagement means for disconnecting one of the first and second engagement means from the drive means upon a predetermined resistance against the driving force applied to one of the first and second engagement means while the other of the first and second engagement means remains operatively connected to the drive means.

The subject invention overcomes the deficiencies in the prior art by providing clutch means which separately connects the first and second engagement means to the drive means. The normal operating resistances against the driving force are distributed evenly between the two engagement means, instead of combined together as in the prior art. Therefore, when a resistance against the driving force is applied against one of the engagement means, only one-half of the minimum threshold resistance is required to disengage the clutch means. In this manner, the clutch means of the subject invention is twice as sensitive to resistances against the driving force than the prior art apparatuses, while still providing the same threshold resistance value for normal operation.

BRIEF DESCRIPTION OF THE DRAWINGS

Other advantages of the present invention will be readily appreciated as the same becomes better understood by reference to the following detailed description when considered in connection with the accompanying drawings wherein.

FIG. is a front elevational view of the drive means of the subject invention taken substantially along lines 4—4 of FIG. 3.

DETAILED DESCRIPTION OF THE PREFERRED EMBODIMENT

Figure 1:
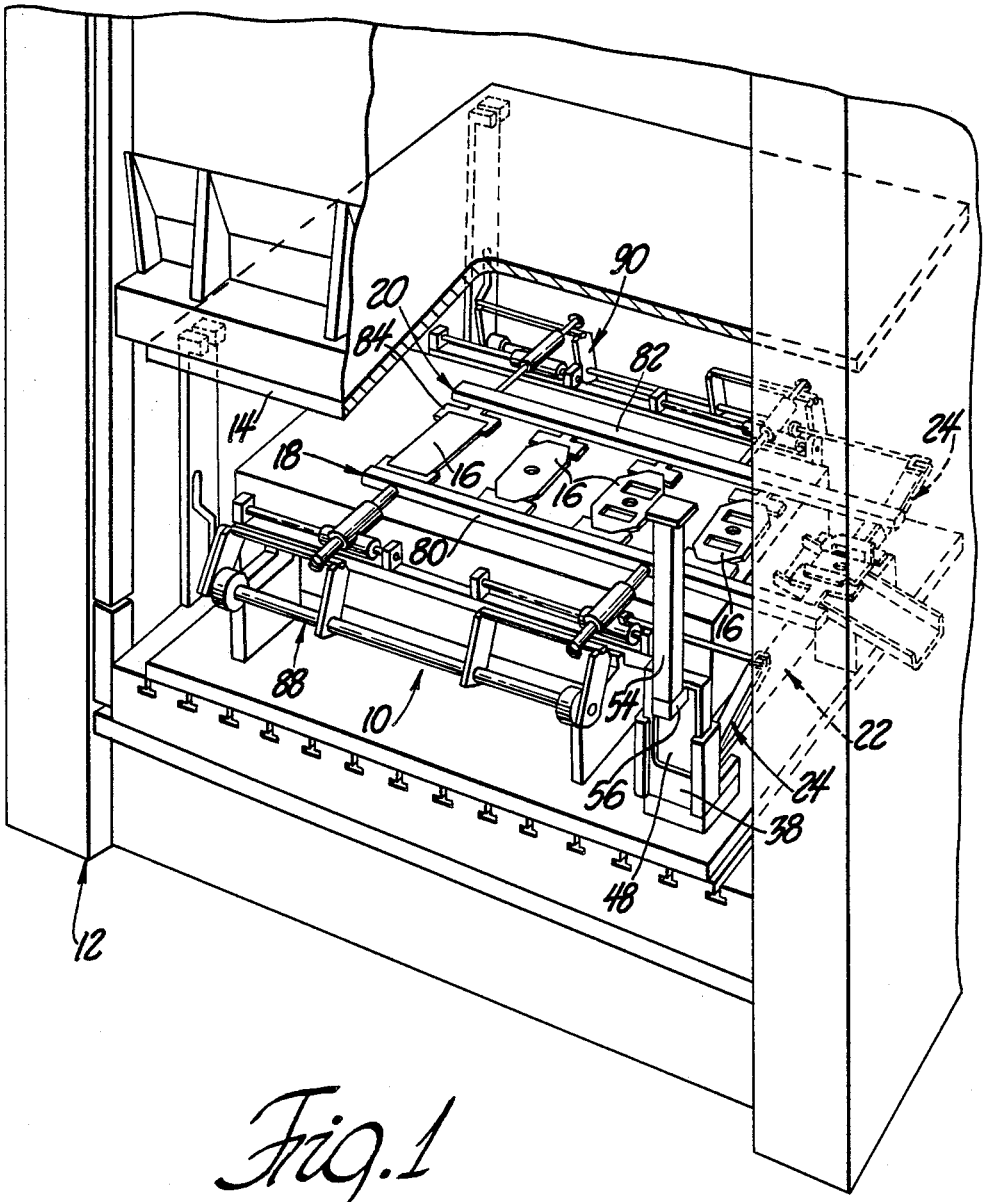
FIG. 1 is an environmental view of the subject invention disposed for operation in a punch press.
Figure 2:
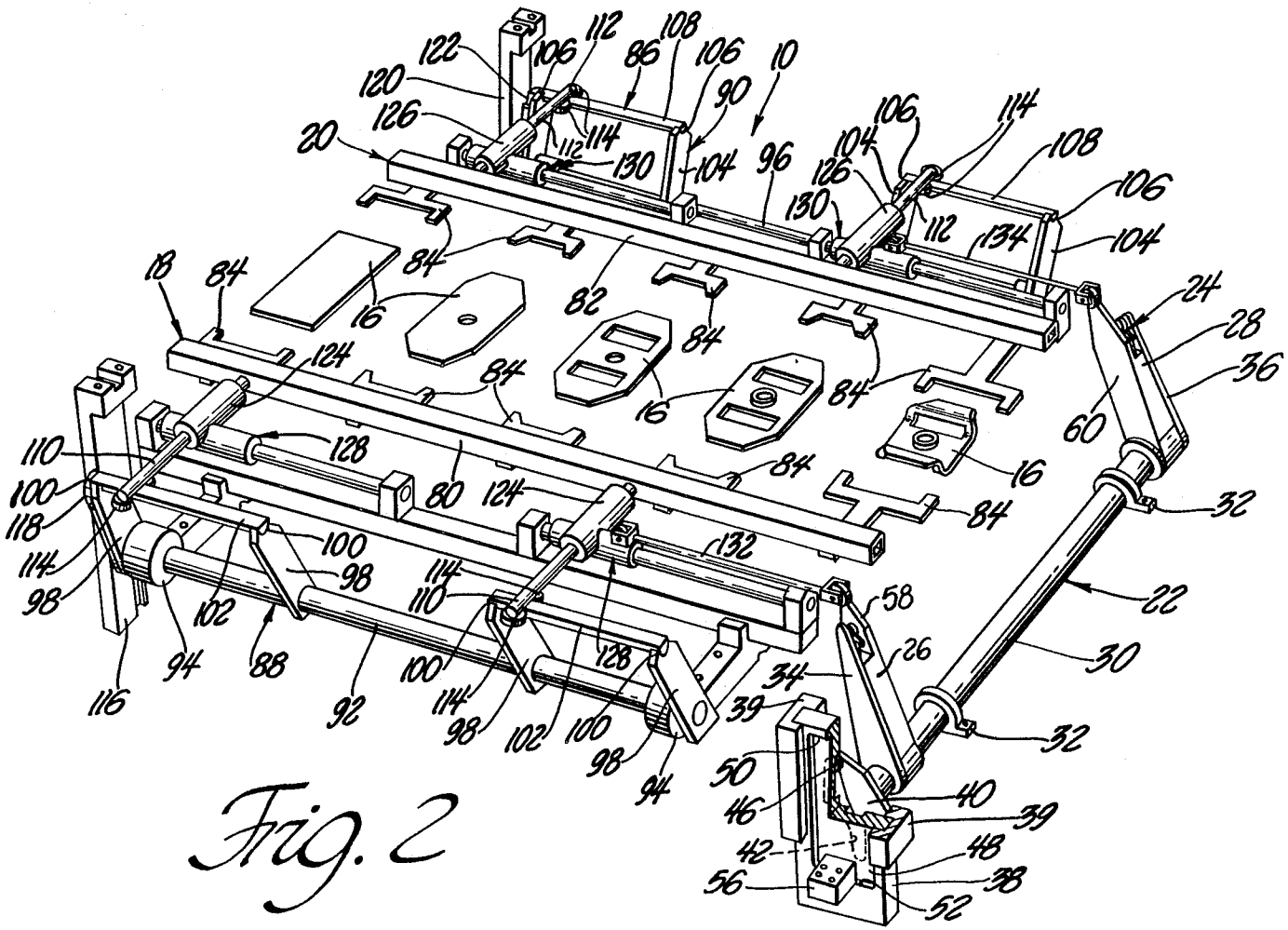
FIG. 2 is a perspective view of the subject invention.

Referring to the Figures, wherein like numerals indicate like or corresponding parts throughout the several views, a workpiece transfer apparatus according to the subject invention is generally shown at 10. The transfer apparatus 10 is particularly adapted for use with a punch press, generally indicated 12 in FIG. 1, having a reciprocating forming member, or ram, 14 actuated against a series of in-line progressively forming die stations. As shown in FIGS. 1 and 2, sheet metal workpieces 16 are moved from one die station to the next during the forming operation for progressive shaping to a finished product.

Referring to FIG. 2, a first engagement means is generally indicated at 18 for engaging one side of each workpiece 16 disposed in a die station. Similarly, a second engagement means, generally indicated at 20, is provided for engaging the other side of the workpieces 16 disposed in the die stations. The first 18 and second 20 engagement means, therefore, function to embrace each workpiece 16 in its respective die station and then transport those workpieces 16 to the next die station in the forming progression.

A drive means, generally indicated at 22, is provided for imparting a driving force to the first 18 and second 20 engagement means to move the workpieces 16 from the old die stations and to the new die stations. The drive means 22 and the first 18 and second 20 engagement means, thus, operate harmoniously as the workpiece transfer apparatus 10 moves the workpieces 16 progressively from one die station to the next. Said another way, the first 18 and second 20 engagement means approach the workpieces 16 from opposite lateral sides, and, once engaged, the drive means 22 moves the workpieces 16 to the next adjacent die station in index fashion. As will be described subsequently, the drive means 22 also repositions the first 18 and second 20 engagement means to a starting position after the workpieces 16 have been indexed to the new stations.

The subject invention 10 is characterized by including a clutch means, generally indicated at 24 in FIGS. 1–5, operatively connecting the drive means 22 to the first 18 and second 20 engagement means for disconnecting one of the first 18 and second 20 engagement means from the drive means 22 upon a predetermined resistance against the driving force applied to the one of the first 18 and second 20 engagement means while the other of the first 18 and second 20 engagement means remains operatively connected to the drive means 22. That is, the clutch means 24 operatively connects the first engagement means 18 to the drive means 22 and also operatively connects the second engagement means 20 to the drive means 22. When resistance against the driving force of the drive means 22, above a predetermined value, is applied to the first engagement means 18, for example, the clutch means 24 will disengage the first engagement means 18 from the drive means 22 while the second engagement means 20 remains operatively connected to the drive means 22.

Figure 3:
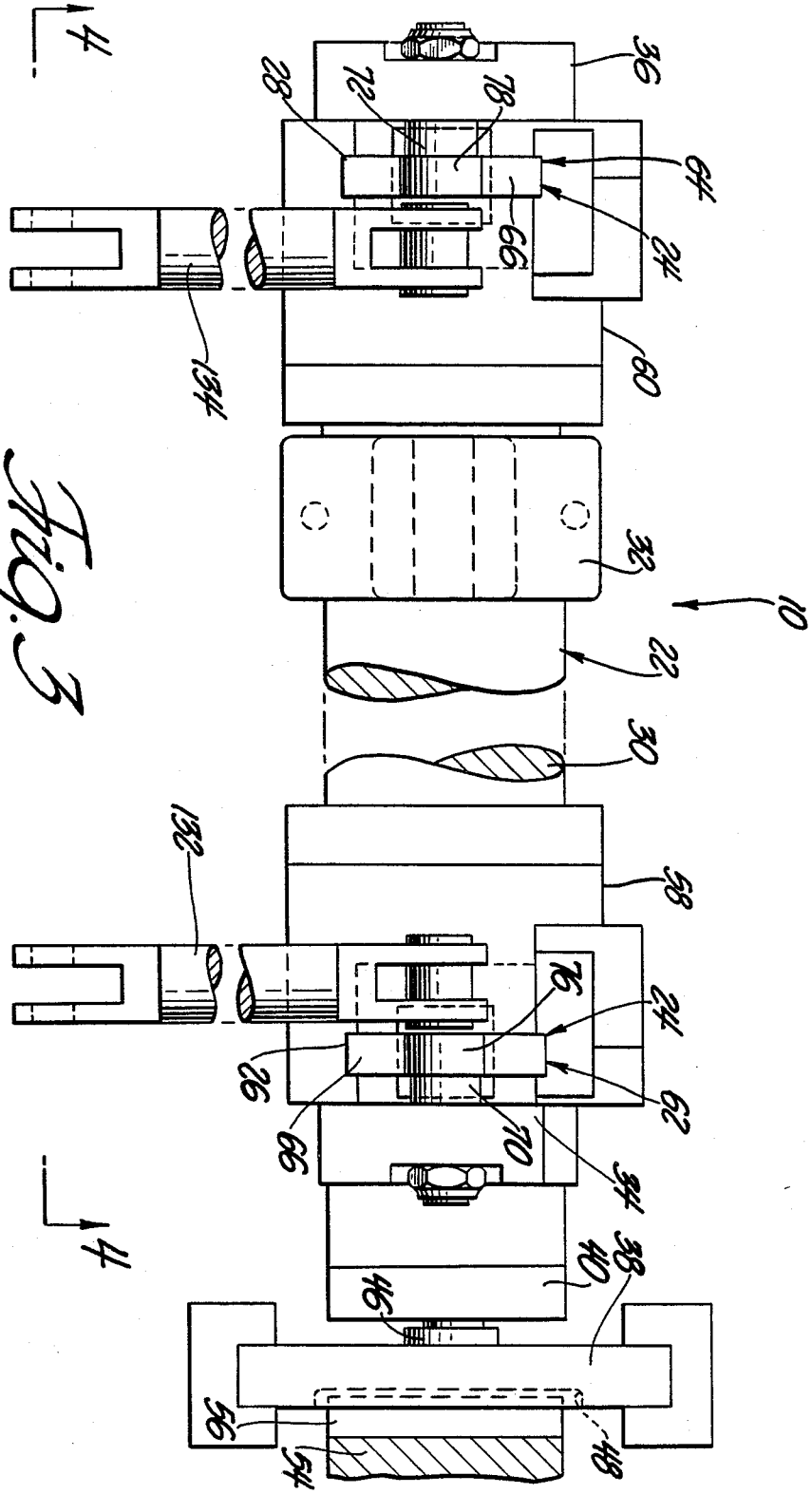
FIG. 3 is a top view of the drive means of the subject invention.
Figure 4:
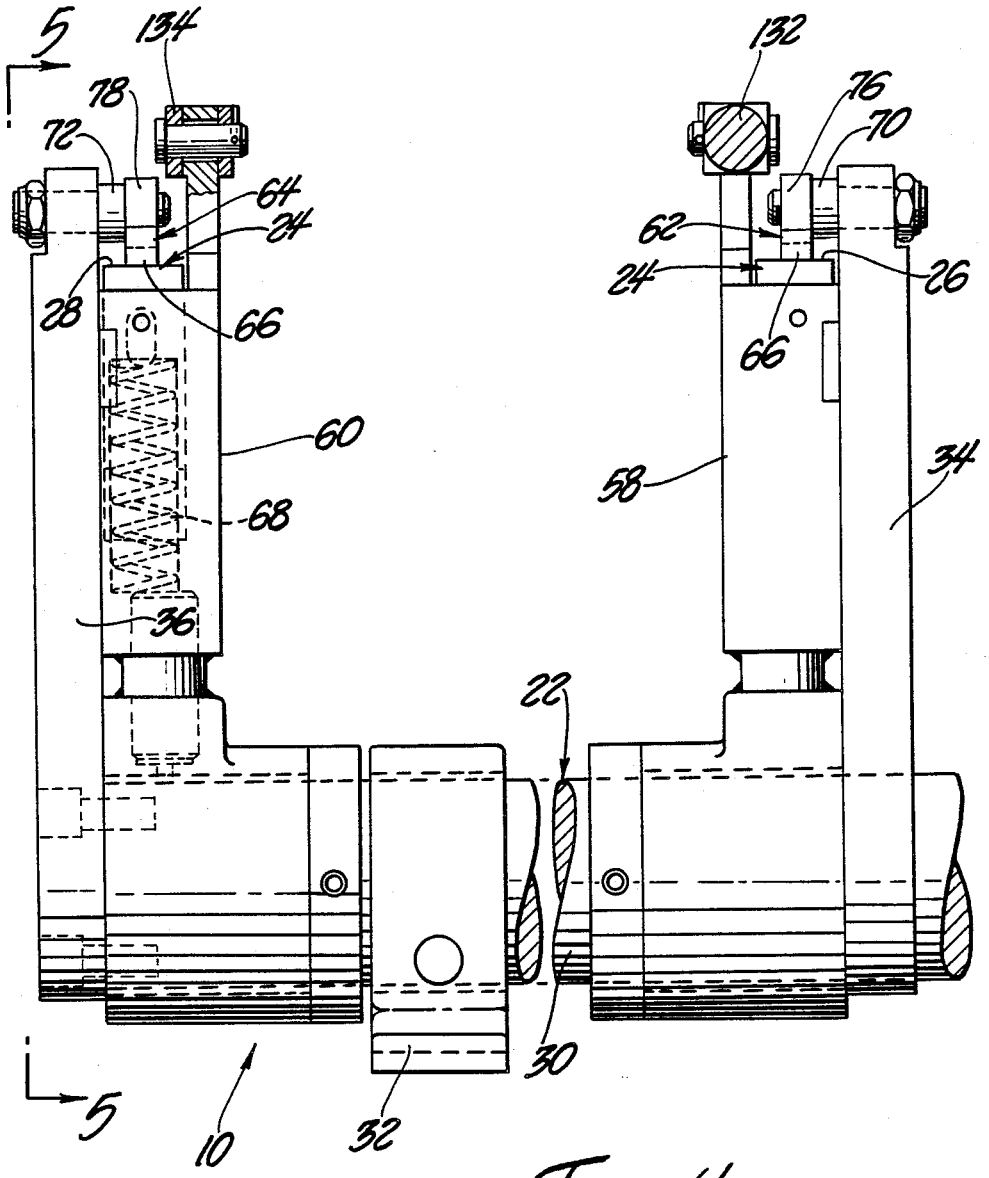

More specifically, as shown in FIGS. 2, 3 and 4, the clutch means 24 includes a first clutch 26 operatively connecting the first engagement means 18 to the drive means 22. The clutch means 24 also includes a second clutch 28 which is separate and distinct from the first clutch 26. The second clutch 28, similarly, operatively connects the second engagement means 20 to the drive means 22. The first 26 and second 28 clutches, in other words, individually attach the respective first 18 and second 20 engagement means to the drive means 22. Upon the occurrence of a predetermined resistance against the driving force applied to one of the first 18 or second 20 engagement means, the associated first 26 or second 28 clutch will disengage while the other first 26 and second 28 clutch remains operatively connected to the drive means 22.

As perhaps best shown in FIG. 2, the drive means 22 includes an elongated drive rock shaft 30 supported for oscillation about a longitudinal axis thereof. The drive rock shaft 30 comprises an elongated cylindrical member supported for rotation about its longitudinal axis in bearings 32 fixed relative to the punch press 12. A first rocker arm 34 extends radially outwardly from the drive rock shaft 30 for oscillation therewith. Similarly, a second rocker arm 36 is axially spaced from the first rocker arm 34 and extends radially outwardly from the drive rock shaft 30 parallel to the first rocker arm 34 for oscillation with the drive rock shaft 30. The first 34 and second 36 rocker arms are fixedly attached to the drive rock shaft 30 and sweep an arcuate path in unison as the drive rock shaft 30 oscillates in the bearings 32.

A drive cam 38, shown in FIGS. 1 and 2, is actuated by the reciprocating press ram 14. The drive cam 38 is supported in channel-shaped guides 39 for linear movement. A drive cam follower 40, attached to the drive rock shaft 30, is responsive to the drive cam 38 for urging the drive rock shaft 30 to oscillate in the bearings 32. The drive cam 38 and drive cam follower 40, that is, transfer mechanical motion from the reciprocating press ram 14 to the drive rock 30. The first 34 and second 36 rocker arms, therefore, are directly motivated to sweep their arcuate paths by the motion of the press ram 14. The drive cam 38 includes a linearly reciprocated plate presenting a curvilinear cam slot 42. A follower element 46 is attached to the drive cam follower 40 adjacent a free swinging distal end thereof. The follower element 46 is disposed in the cam slot 42 of the drive cam 38 for tracing the curvilinear path of the cam slot 42 during reciprocation of the drive cam 38.

The drive cam 38 includes a lost motion connection 48 for operatively connecting the drive means 22 to the reciprocating press ram 14. As perhaps best shown in FIG. 1, the lost motion connection 48 comprises an elongated slide channel having upper 50 and lower 52 abutment edges. A rigid extension 54 extends downwardly from the press ram 14 and includes a leg 56 disposed in the channel of the lost motion connection 48. As the press ram 14 reciprocates, and the extension 54 therewith, the leg 56 travels in the channel of the lost motion connection 48 toward either the upper 50 or lower 52 abutment edges. As will be discussed in detail subsequently, as the extension 54 moves downwardly, the leg 56 engages the lower abutment edge 52 and moves the drive cam 38 downwardly. The drive cam follower 40 is rotated due to the follower element 46 in the cam slot 42. This motion directly rotates the drive rock shaft 30, thereby displacing the first 34 and second 36 rocker arms. As the press ram 14 travels upwardly, the leg 56 of the extension 54 travels through a lost motion distance until contacting the upper abutment edge 50 to urge the drive cam 38 upwardly and subsequently rotate the drive rock shaft 30 along with the attached first 34 and second 36 rocker arms in the opposite direction.

As best shown in FIGS. 2 and 4, the first engagement means 18 includes a first follower arm 58 rotatably disposed about the drive rock shaft 30 adjacent the first rocker arm 34. Similarly, the second engagement means 20 includes a second follower arm 60 rotatably disposed about the drive rock shaft 30 adjacent the second rocker arm 36. The first 58 and second 60 follower arms, that is, are journaled about the drive rock shaft 30 for free unrestricted arcuate movement. The first clutch 26 is fixedly attached to the first follower arm 58. Likewise, the second clutch 28 is fixedly attached to the second follower arm 60. The first 26 and second 28 clutches, therefore, yieldably attach the first follower arm 58 to the first rocker arm 34 and the second follower arm 60 to the second rocker arm 36, respectively. In this manner, when the predetermined resistance against the driving force is encountered during operation, the first 26 or second 28 clutches will disengage their respective first 34 or second 36 rocker arm from the first 58 or second 60 follower arm.

Figure 5:
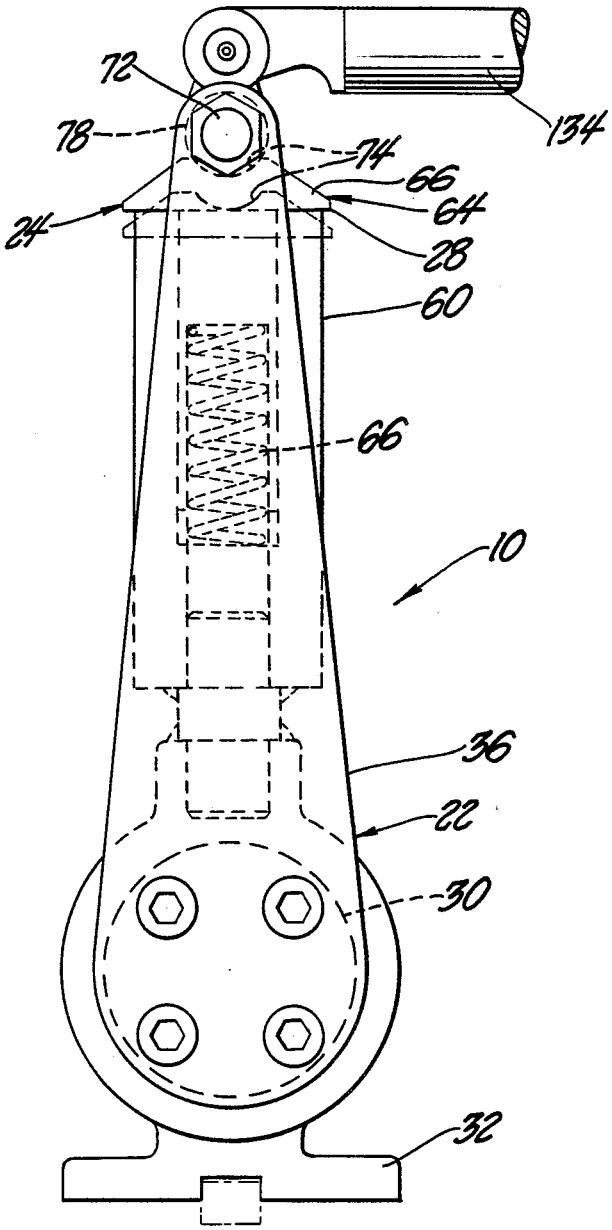
FIG. 5 is an end view of the drive means of the subject invention taken substantially along lines 5—5 of FIG. 4.

More particularly, as best shown in FIGS. 4 and 5, the first clutch 26 includes a yieldable element, generally indicated at 62, and the second clutch 28 includes an identical yieldable element, generally indicated at 64. The yieldable elements 62, 64 are responsive to resistances above a predetermined magnitude against the driving force and function to disengage either the first rocker arm 34 from the first follower arm 58 or the second rocker arm 36 from the second follower arm 60 upon application of the predetermined resistance against the driving force.

Specifically, the yieldable elements 62, 64 of the first 26 and second 28 clutches, respectively, include a slide bar 66 and a biasing means 68. The biasing means 68 preferably comprises a compression spring. (Common reference numerals are used to denote the corresponding elements in both of the yieldable elements 62, 64 due to their identical structures).

As perhaps best illustrated in FIG. 4, the first rocker arm 34 includes an integral first pin 70 extending laterally from the distal, or free swinging, end thereof. The first pin 70 engages the yieldable element 62 of the first clutch 26 to operatively connect the first engagement means 18 to the drive means 22. Also, the second rocker arm 36 includes an integral second pin 72 extending laterally from the free swinging end thereof. The second pin 72 engages the yieldable element 64 of the second clutch 28 to operatively connect the second engagement means 20 the drive means 22.

Each of the slide bars 66 include an arcuate notch 74, best shown in FIG. 5, disposed to receive the respective first 70 and second 72 pins. The biasing means 68 thus biases, or urges, the slide bars 66 against their respective first 70 and second 72 pins so that the arcuate notches 74 are seated against the pins 70, 72 to securely connect the drive means 22 to the respective first 18 and second 20 engagement means. Preferably, the first 70 and second 72 pins include a roller element 76, 78, respectively, for reducing the friction occurring when the respective first 18 and second 20 engagement means are disconnecting from the drive means 22. That is, the roller elements 76, 78 are supported for rotation about an axis passing through the respective pins 70, 72 and seat in the arcuate notches 74 of the slide bars 66 to reduce the friction required to displace the first 70 and second 72 pins from the yieldable elements 62, 64.

Referring again to FIGS. 1 and 2, the first engagement means 18 includes a first jaw 80 responsive to the movements of the first follower arm 58. Similarly, the second engagement means 20 includes a second jaw 82 which is responsive to the movements of the second follower arm 60. The first 80 and second 82 jaws extend parallel to each other and are spaced laterally across the workpieces 16. The first 80 and second 82 jaws, therefore, extend parallel to the direction of the die progression and perpendicular to the longitudinal axis of the drive rock shaft 30. The first 80 and second 82 jaws are mechanically connected, through the first 26 and second 28 clutches, respectively, to the first 34 and second 36 rocker arms so that as the first 34 and second 36 rocker arms oscillate, the first 80 and second 82 jaws are longitudinally displaced at the same time. The first 80 and second 82 jaws include opposing pairs of workpiece engaging fingers 84 having contoured surfaces adapted to embrace for transportation the individual workpieces 16 in their respective die stations.

A lateral actuator means, generally indicated at 86 in FIGS. 1 and 2, is provided for moving the first 80 and second 82 jaws simultaneously, laterally of their parallel extent to engage opposite sides of the workpieces 16 in the die stations. The lateral actuator means 86, therefore, operates to move the first 80 and second 82 jaws, at the same time, laterally toward and away from the workpieces 16 in the die stations. More specifically, the lateral actuator means 86 comprises a first actuator assembly, generally indicated at 88, responsive to the movements of the reciprocating press ram 14 for moving the first jaw 80 and away from the workpieces 16. Likewise, the lateral actuator means 86 also comprises a second actuator assembly, generally indicated at 90, responsive to the movements of the reciprocating press ram 14 for moving the second jaw 82 toward and away from the workpieces 16.

The first actuator assembly 88 includes a first engagement rock shaft 92 supported in bearings 94 for oscillation about an axis parallel to the first jaw 80. In like manner, the second actuator assembly 90 includes a second engagement rock shaft 96 supported for oscillation about an axis parallel to the second jaw 82.

The first actuator assembly 88 includes four support arms 98 fixedly attached to and extending radially outwardly from the first engagement rock shaft 92 to free swinging distal ends 100. A first crank bar 102 is supported on the distal ends 100 of the first support arms 98 extending parallel to the first engagement rock shaft 92. In the preferred embodiment as illustrated, the first crank bar 102 is sectioned into two separate elements spanning the distal ends 100 of two adjacent left and adjacent right first support arms 98.

In mirror-like fashion to the first actuator assembly 88, the second actuator assembly 90 includes four second support arms 104 fixedly attached to and extending radially outwardly from the second engagement rock shaft 96 to distal free swinging ends 106. A second crank bar 108 is supported on the distal ends 106 of each of the second support arms 104 and extends parallel to the second engagement rock shaft 96. Like the first crank bar 102, the second crank bar 108 is also sectioned into two equal length members spanning between adjacent left hand and right hand second support arms 104.

The first actuator assembly 88 includes a first push tube 110 extending between the first crank bar 102 and the first jaw 80 for transferring forces therebetween. In like manner, the second actuator assembly 90 includes a second push tube 112 extending between the second crank bar 108 and the second jaw 82 for transferring forces therebetween. The first 110 and second 112 push tubes are connected to their respective first 102 and second 108 crank bars by two rollers 114. The two rollers 114 of each push tube 110, 112 are disposed on each lateral side of the associated crank bar 102, 108 for allowing the first 110 and second 112 push tubes to travel longitudinally along their respective first 102 and second 108 crank bars.

The first actuator assembly 88 includes a first linear cam 116 which is moveable with the reciprocating press ram 14. A first cam follower 118 extends radially outwardly from the first engagement rock shaft 92 and is responsive to the movement of the first cam 116. That is, in the well known manner, the first cam follower 118 includes an element (not shown) disposed in a curvilinear slot in the first cam 116 which traces the curvature of that slot to actuate the first cam follower 118. In a similar manner, the second actuator assembly 90 includes a second linear cam 120 moveable with the reciprocating press ram 14. A second cam follower 122 is fixedly attached to and extends radially outwardly from the second engagement rock shaft 96. The second cam follower 122, in known manner, is responsive to the movement of the second cam 120. Preferably, one safety clutch (not shown) is provided for each of the first 88 and second 90 actuator assemblies to disengage the jaws 80, 82 upon the occurrence of a jam.

Each of the first push tubes 110 include a first linear guide bearing 124 for supporting the first push tubes 110 in a parallel orientation to guide their movement perpendicular to the axis of the first engagement rock shaft 92. Also, each of the second push tubes 112 include a second linear guide bearing 126 for supporting the second push tubes 112 in a parallel orientation to guide their movement perpendicular to the axis of the second engagement rock shaft 96. Each first linear guide bearing 124 is fixedly attached to a first guide rail support means, generally indicated at 128, for guiding travel of the first linear guide bearings 124 in a direction parallel to the axis of the first engagement rock shaft 92. That is, as the drive means 22 actuates the first engagement means 18 to move, the first guide rail support means 128, along with rollers 114 on the first push tubes 110, provide smooth accurate travel of the first jaw 80. In like manner, each second linear guide bearing 126 is fixedly attached to a second guide rail, generally indicated at 130, for guiding travel of the second linear guide bearings 126 in a direction parallel to the axis of the second engagement rock shaft 96.

To interconnect the associated elements, the first engagement means 18 includes a first link 132 which extends from a pivotal connection at the first follower arm 58 to a pivotal connection at the first guide rail means 128. Also, the second engagement means 20 includes a second link 134 extending from a pivotal connection at the second follower arm 60 to a pivotal connection at the second guide rail means 30. The first 132 and second 134 links are rigid members which transmit axial forces from the respective first 58 and second 60 follower arms to, ultimately, the first 80 and second 82 jaws.

OPERATION OF THE PREFERRED EMBODIMENT

Having thus described the elements in detail, one complete operating cycle of the preferred embodiment of the subject transfer apparatus 10 will be addressed presently.

Beginning from a position wherein the punch press ram 14 is fully closed down upon the workpieces 16, the first 80 and second 82 jaws are in a position retracted, i.e., pulled away from, the workpieces 16 to allow adequate clearance for the dies to close upon the workpieces 16. As the press ram 14 begins to ascend, the first 116 and second 120 cams of the lateral actuator means 86 actuate the first 92 and second 96 engagement rock shafts to oscillate while the leg 56 of the extension 54 travels through the lost motion connection 48 on the drive cam 38. Thus, as the drive means 22 remains stationary, the first 102 and second 108 crank bars force their respective push tubes 110, 112 laterally toward the workpieces 16 with the workpiece engaging fingers 84 of the first 80 and second 82 jaws preparing to embrace opposite sides of the workpieces 16 in the dies. A moment after the first 80 and second 82 jaws have completed their laterally inward travel so that the fingers 84 are engaging the workpieces 16, and while the press ram 14 continues to ascend, the leg 56 of the extension 54 contacts the upper abutment edge 50 of the lost motion connection 48 on the drive cam 38 and begins to urge the drive cam 38 upwardly. The lateral actuator means 86 remains stationary after the drive means 22 begins to operate. The drive cam follower 40 of the drive means 22 is actuated to oscillate the drive rock shaft 38 and rotate the affixed first 34 and second 36 rocker arms. The first 70 and second 72 pins of the associated rocker arms 34, 36, engaging the respective first 26 and second 28 clutches, move the first 58 and second 60 follower arms therewith. The first 132 and second 134 links are thus pulled in the longitudinal direction and urge the first 124 and second 126 linear guide bearings along their respective support means 128, 130. In this manner, the workpieces 16 are carried to their respective next die stations and deposited therein just before the press ram 14 reaches the peak of its ascent.

As the ram 14 begins to descend, the leg 56 of the extension 54 moves back through the lost motion connection 48 on the drive cam 38 while the first 88 and second 90 actuator assemblies retract, or withdraw, the first 80 and second 82 jaws from the workpieces 16. A moment after the first 80 and second 82 jaws have reached the extent of their retracted position, the leg 56 of the extension 52 engages the lower abutment edge 52 of the lost motion connection 54 on the drive cam 38 and begins to urge the drive cam 38 downwardly. The drive means 22, in reverse manner as that described above, moves both the first 18 and second 20 engagement means longitudinally back to the initial starting position ready to engage the workpieces 16 again, while the lateral actuator means 86 maintains the jaws 80, 82 in their retracted position.

The subject invention improves upon the prior art by providing separate first 26 and second 28 clutches to individually disengage the first 18 or second 20 engagement means upon the occurrence of a resistance of a predetermined magnitude against the driving force.

This is perhaps best illustrated by way of example. If, for instance, a one hundred pound threshold resistance against the driving force is required to disengage the clutch means 24, then each of the first 26 and second 28 clutches are set to disengage at the occurrence of a fifty pound resistance against the driving force. In the prior art, a one hundred pound resistance is maintained between the drive means and the workpieces through the single clutch. However, by providing two clutches 26, 28, one clutch between each engagement means 18, 20 and the drive means 22, the subject invention reduces the resistance a jammed workpiece 16 must exert against the driving force by fifty percent.

The result is that the resistance, as caused by a workpiece 16 jam or the like, against the driving force need only exceed fifty pounds (referring to the previous example) on either of the first 18 or second 20 engagement means. According to the prior art teaching, a resistance against the driving force must exceed one hundred pounds. Therefore, the subject transfer apparatus 10 provides a substantially more sensitive clutch means 24 than the prior art to better protect the expensive punch press equipment and prevent costly down time of broken presses.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A workpiece transfer apparatus (10) for a press (12) of the type including a reciprocating forming member (14) actuated against a series of in-line progressively forming die stations, said apparatus (10) comprising: first engagement means (18) for engaging one side of a workpiece (16) disposed in a die station; second engagement means (20) for engaging the other side of the workpiece (16) disposed in the die station; drive means (22) for imparting a driving force to said first (18) and second (20) engagement means to move the workpiece (I6) from the die station; and characterized by including clutch means (24) operatively connecting said drive means (22) to said first (18) and second (20) engagement means for disconnecting one of said first (18) and second (20) engagement means from said drive means (22) upon a predetermined resistance against said driving force applied to the one of said first (18) and second (20) engagement means while the other of said first (18) and second (20) engagement means remains operatively connected to said drive means (22), said cluctch means (24) including a first clutch (26) operatively connecting said first engagement means (18) to said drive means (22), and a second clutch (28) distinct from said first cluth (26) operatively connecting said second engagement means (20) to said drive means (22).

2. An apparatus (10) as set forth in claim 1 further characterized by each of said first (26) and second (28) clutches including a yieldable element (62,64) responsive to said predetermined resistance against said driving force.

3. An apparatus (10) as set forth in claim 2 further characterized by said drive means (22) including an elongated drive rock shaft (30) supported for oscillation about a longitudinal axis thereof.

4. An apparatus (10) as set forth in claim 3 further characterized by said drive means (22) including a first rocker arm (34) extending radially outwardly from said drive rock shaft (30) for oscillation therewith, and a second rocker arm (36) axially spaced from said first rocker arm (34) and extending radially outwardly from said drive rock shaft (30) parallel to said first rocker arm (34) for oscillation therewith.

5. An apparatus (10) as set forth in claim 4 further characterized by said first engagement means (18) including a first follower arm (58) rotatably disposed about said drive rock shaft (30) adjacent said first rocker arm (34), and said second engagement means (20) including a second follower arm (60) rotatably disposed about said drive rock shaft (30) adjacent said second rocker arm (36).

6. An apparatus (10) as set forth in claim 5 further characterized by including a drive cam (38) for actuation by the reciprocating member (14), and a drive cam follower (40) responsive to said drive cam (38) for urging said drive rock shaft (30) to oscillate.

7. An apparatus (10) as set forth in claim 6 further oharacterized by said drive cam (38) including a linearly reciprocating plate presenting a curvilinear cam slot (42).

8. An apparatus (10) as set forth in claim 7 further characterized by said drive cam follower (40) including an arm extending radially outwardly from said drive rock shaft (30) to a distal end (44), and a follower element (46) adjacent said distal end (44) and disposed in said cam slot (42) of said drive cam (38).

9. An apparatus (10) as set forth in claim 8 further characterized by said drive cam (38) including a lost motion connection (48) for operatively connecting said drive means (22) to the reciprocating member (14).

10. An apparatus (10) as set forth in claim 9 further characterized by said first clutch (26) being fixedly attached to said first follower arm (58), and said second clutch (28) being fixedly attached to said second follower arm (60).

11. An apparatus (10) as set forth in claim 10 further characterized by said first rocker arm (34) including an integral first pin (70) engaging said yieldable element (62) of said first clutch (26) to operatively connect to said drive means (22), and said second rocker arm (36) including an integral second pin (72) engaging said yieldable element (64) of said second clutch (28) to operatively connect to said drive means (22).

12. An apparatus (10) as set forth in claim 11 further characterized by each of said yieldable elements (62,64) of said first (26) and second (28) clutches including a slide bar (66) and biasing means (68) for biasing said slide bar (66) against respective said first (70) and second (72) pins.

13. An apparatus (10) as set forth in claim 12 further characterized by each of said slide bars (66) including an arcuate notch (74) disposed to receive respective said first (70) and second (72) pins to operatively connect said drive means (22) to respective said first (18) and second (20) engagement means.

14. An apparatus (10) as set forth in claim 13 further characterized by each of said first (70) and second (72) pins including a roller element (76,78) receivable in said notch (74) of respective said slide bars (66) to facilitate disconnecting respective said first (18) and second (20) engagement means from said drive means (22).

15. An apparatus (10) as set forth in claim 14 further characterized by said biasing means (68) including a compression spring.

16. An apparatus (10) as set forth in claim 14 further characterized by said first engagement means (18) including a first jaw (80) responsive to the movement of said first follower arm (58), and said second engagement means (20) including a second jaw (82) responsive to the movement of said second follower arm (60).

17. An apparatus (10) as set forth in claim 16 further characterized by said first (80) and second (82) jaws extending parallel to each other and spaced across the workpieces (16) in their die stations.

18. An apparatus (10) as set forth in claim 17 further characterized by said longitudinal axis of said drive rock shaft (30) supported in a direction perpendicular to said first (80) and second (82) jaws.

19. An apparatus (10) as set forth in claim 18 further characterized by said first (80) and second (82) jaws including opposing pairs of workpiece engaging fingers (84).

20. An apparatus (10) as set forth in claim 19 further characterized by including lateral actuator means (86) for moving said first (80) and second (82) jaws in unison laterally of their parallel extent to engage opposite sides of the workpieces (16) in the die stations.

21. An apparatus (10) as set forth in claim 20 further characterized by said lateral actuator means (86) including a first actuator assembly (88) responsive to the movement of the reciprocating member (14) for moving said first jaw (80) toward and away from the workpieces (16), and a second actuator assembly (90) responsive to the movement of the reciprocating member (14) for moving said second jaw (82) toward and away from the workpieces (16).

22. An apparatus (10) as set forth in claim 21 further characterized by said first actuator assembly (88) including a first engagement rock shaft (92) supported for oscillation about an axis parallel to said first jaw (80), and said second actuator assembly (90) including a second engagement rock shaft (96) supported for oscillation about an axis parallel to said second jaw (82).

23. An apparatus (10) as set forth in claim 22 further characterized by said first actuator assembly (88) including at least one first support arm (98) extending radially outwardly from said first engagement rock shaft (92) to a distal end (100), and a first crank bar (102) supported on said distal end (100) of said first support arm (98) extending parallel to said first engagement rock shaft (92).

24. An apparatus (10) as set forth in claim 23 further characterized by said second actuator assembly (90) including at least one second support arm (104) extending radially outwardly from said second engagement rock shaft (96) to a distal end (106), and a second crank bar (108) supported on said distal end (106) of said second support arm (104) extending parallel to said second engagement rock shaft (96).

25. An apparatus (10) as set forth in claim 24 further characterized by said first actuator assembly (88) including a first push tube (110) extending between said first crank bar (102) and said first jaw (80) for transferring forces therebetween, and said second actuator assembly (90) including a second push tube (112) extending between said second crank bar (108) and said second jaw (82) for transferring forces therebetween.

26. An apparatus (10) as set forth in claim 25 further characterized by said first actuator assembly (88) including a first cam (116) moveable with the reciprocating member (14) and a first cam follower (118) extending radially outwardly from said first enagement rock shaft (92) responsive to the movement of said first cam (116).

27. An apparatus (10) as set forth in claim 26 further characterized by said second actuator assembly (90) includinq a second cam (120) moveable with the reciprocating member (14) and a second cam follower (122) extending radially outwardly from said second engagement rock shaft (96) responsive to the movement of said second cam (120).

28. An apparatus (10) as set forth in claim 27 further characterized by said first push tube (110) including a first linear guide bearing (124), and said second push tube (112) including a second linear guide bearing (126).

29. An apparatus (10) as set forth in claim 28 further characterized by said first linear guide bearing (124) fixedly attached to first guide rail support means (128) for guiding travel of said first linear guide bearing (124) in a direction parallel to said first engagement rock shaft (92).

30. An apparatus (10) as set forth in claim 29 further characterized by said second linear guide bearing (126) fixedly attached to second guide rail support means (130) for guiding travel of said second linear guide bearing (126) in a direction parallel to said second engagement rock shaft (98).

31. An apparatus (10) as set forth in claim 30 further characterized by said first engagement means (18) including a first link (132) extending from a pivotal connection at said first follower arm (58) to a pivotal connection at said first guide rail support means (128), and said second engagement means (20) including a second link (134) extending from a pivotal connection at said second follower arm (60) to a pivotal connection at said second guide rail support means (130).

32. A workpiece transfer apparatus (10) for a press (12) of the type including a reciprocating forming member (14) actuated against a series of in-line progressively forming die stations, said apparatus (10) comprising: a first jaw (80) for engaging one side of a workpiece (16) in a die station; a second jaw (82) for engaging the other side of the workpiece (16) in the die station; a drive rock shaft (30) responsive to the movements of the reciprocating forming member (14); a first rocker arm (34) extending radially outwardly from said drive rock shaft (30) for oscillation therewith; a second rocker arm (36) extending radially outwardly from said drive rock shaft (30) for oscillation therewith; a first follower arm (58) rotatably disposed about said drive rock shaft (30) adjacent said first rocker arm (34); a second follower arm (60) rotatably disposed about said drive rock shaft (30) adjacent said second rocker arm (36); a first link (132) extending from said first follower arm (58) to said first jaw (80) for moving said first jaw (80) longitudinally of the die stations; a second link (134) extending from said second follower arm (60) to said second jaw (82) for moving said second jaw (82) longitudinally of the die stations; and characterized by including a first clutch (26) disposed between said first rocker arm (34) and said first follower arm (58); and a second clutch (28) disposed between said second rocker arm (36) and said second follower arm (60).

* * * * *